US005831537A

United States Patent [19]

Marman

[11] Patent Number: 5,831,537

[45] Date of Patent: Nov. 3, 1998

[54] ELECTRICAL CURRENT SAVING COMBINED SMOKE AND FIRE DETECTOR

[75] Inventor: Douglas H. Marman, Ridgefield, Wash.

[73] Assignee: SLC Technologies, Inc., Tualatin, Oreg.

[21] Appl. No.: 958,628

[22] Filed: Oct. 27, 1997

[51] Int. Cl.[6] ..... G08B 17/10

[52] U.S. Cl. ..... 340/628; 340/630; 340/632

[58] Field of Search ..... 340/628, 629, 340/630, 632, 522, 286.05, 635

[56] References Cited

U.S. PATENT DOCUMENTS

| | | | |
|---|---|---|---|
| 3,801,972 | 4/1974 | Ho kim et al. | 340/237 R |
| 4,074,243 | 2/1978 | Bogen et al. | 340/237 R |
| 4,163,969 | 8/1979 | Enemark | 340/630 |
| 4,319,229 | 3/1982 | Kirkor | 340/521 |
| 4,638,304 | 1/1987 | Kimura et al. | 340/500 |
| 4,688,021 | 8/1987 | Buck et al. | 340/521 |
| 5,053,754 | 10/1991 | Wong | 340/632 |
| 5,079,422 | 1/1992 | Wong | 250/343 |
| 5,376,924 | 12/1994 | Kubo et al. | 340/632 |
| 5,422,629 | 6/1995 | Minnis | 340/628 |
| 5,530,433 | 6/1996 | Morita | 340/628 |
| 5,546,074 | 8/1996 | Bernal et al. | 340/628 |
| 5,691,704 | 11/1997 | Wong | 340/628 |

*Primary Examiner*—Jeffery A. Hofsass
*Assistant Examiner*—Anh La
*Attorney, Agent, or Firm*—Stoel Rives LLP

[57] ABSTRACT

A fire detection system (10) includes a smoke detector (52) that measures smoke particle density indicative of smoldering fires and a $CO_2$ detector (90) that measures $CO_2$ concentration indicative of flaming fires. In a first operating current saving method, the smoke detector is operated at a normal PRF while the $CO_2$ detector is operated at a very slow PRF. Smoke density measurements (14) produced by the smoke detector are compared with a set of tentative fire detection criteria (18, 20, 22, 14), and if met, the $CO_2$ detector PRF is substantially increased to rapidly produce $CO_2$ concentration measurements (26) that are compared to a set of conclusive fire detection criteria (30, 32, 36, 38). In a second operating current saving method, the $CO_2$ detector is operated at a normal PRF while the smoke detector is operated at a zero PRF. $CO_2$ concentration measurements produced by the $CO_2$ detector are compared with a set of tentative fire detection criteria (30, 32, 36, 38), and if met, the smoke detector PRF is substantially increased to rapidly produce smoke density measurements that are compared to a set of conclusive fire detection criteria (18, 20, 22, 24). In a reliability improving operating method, electrical current draw and/or signal presence of the smoke and $CO_2$ detectors are monitored to determine whether either detector has failed. If a failure is detected, fire detection criteria normally employed are changed to criteria optimized for the remaining detector.

12 Claims, 5 Drawing Sheets

ELECTRICAL CURRENT SAVING COMBINED SMOKE AND FIRE DETECTOR

TECHNICAL FIELD

This invention relates to fire and smoke detection and control systems and more particularly to a combined smoke and fire detector system that employs electrical current-saving and reliability-improving operating methods.

BACKGROUND OF THE INVENTION

Remarkable growth has been experienced in the home smoke detector market, particularly among single-station, battery-operated, ionization-mode smoke detectors. This growth, coupled with clear evidence from actual fires and fire statistics of the lifesaving effectiveness of detectors, has made the home smoke detector the fire safety success story of the past two decades.

However, recent studies of the operational status of home smoke detectors revealed an alarming statistic that as many as one-fourth to one-third of smoke detectors are nonoperational at any one time. Over half of the nonoperational smoke detectors are attributable to missing batteries, with the remainder resulting from dead batteries and nonworking smoke detectors. Research revealed the principal cause of missing batteries was homeowner frustration over nuisance alarms caused by controlled fires, such as cooking flames. Nuisance alarms are also caused by nonfire sources, such as shower vapors emanating from a bathroom, dust or debris stirred up during cleaning, or oil vapors escaping from a kitchen.

Centralized fire detection systems are likewise important in protecting the occupants of commercial and industrial buildings. Nuisance alarms are particularly detrimental in the commercial setting because they cause costly inconvenience to building occupants and create a dangerous lack of confidence in the validity of future alarms.

Ionization type smoke detectors are prone to nuisance alarms because they are particularly sensitive to visible and invisible diffused particulate matter, especially when the fire alarm threshold is set very low to meet the mandated response time for ANSI/UL 268 certification for various types of fires. Visible particulate matter ranges in size from 4 to 5 microns in a minimum dimension (although small particles can be seen as a haze when present in high mass density) and is generated copiously in most open fires or flames. However, ionization detectors are most sensitive to invisible particles ranging from 0.01 to 1.0 micron in a minimum dimension. Most household nonfire sources, as described briefly above, generate mostly invisible particulate matters, which explains why most home smoke detectors produce so many nuisance alarms.

The ionization smoke detector nuisance alarm problem, which results in a significant portion of ionization smoke detectors being rendered nonoperational, led to the development and use of the photoelectric smoke detector. Photoelectric smoke detectors are less prone to nuisance alarms because they are most sensitive to visible particulate matter than to invisible particulate matter. Unfortunately, they respond slowly to flaming fires, which initially generate invisible particulate matter. To overcome this drawback, the fire alarm sensitivity of photoelectric smoke detectors is set very high to meet the ANSI/UL 268 certification requirements, which again leads to nuisance alarms. Thus the nuisance alarm problem has been long recognized but remains unsolved. It is equally apparent that a new type of fire detector is urgently needed to resolve the dangerous ineffectiveness of present-day smoke detectors.

Over the past two decades, workers in the fire fighting and prevention industry have been seeking faster response than is available with current smoke detectors. Increasing smoke detector sensitivity by lowering the light obscuration detection threshold speeds up their response, but increases the nuisance alarm rate. From this perspective, it is all the more apparent that a better fire detector is urgently needed.

Recognizing that virtually all fires generate copious amounts of $CO_2$ gas, a new type of $CO_2$ detecting fire detector was disclosed by Jacob Y. Wong in U.S. Pat. No. 5,053,754. The $CO_2$ detecting fire detector rapidly responds to fires by determining the rate of change of $CO_2$ concentration caused by a fire.

The superiority of $CO_2$ detecting fire detectors over smoke detectors, in terms of response speed and reduced nuisance alarms, has been well established. Co-pending U.S. patent application No. 08/077,488, filed Nov. 14, 1994, for FALSE ALARM RESISTANT FIRE DETECTOR WITH IMPROVED PERFORMANCE and U.S. patent application Ser. No. 08/593,253, filed Jan. 30, 1996, for AN IMPROVED FIRE DETECTOR further disclose the advantage of combining a $CO_2$ detector with a smoke detector to form a rapidly responding, nuisance alarm-resistant fire detector.

A smoke detector typically draws about 200 microamps of operating current, whereas a $CO_2$ detector can draw from 200 microamps to many milliamps depending on the type of $CO_2$ sensor used. Therefore, a combined smoke/$CO_2$ detector draws more than twice the operating current of a smoke detector alone. Clearly, a battery-powered combined smoke/$CO_2$ detector will deplete batteries at an unacceptable rate. In industrial systems in which combined smoke/$CO_2$ detectors draw power from a wire loop, far fewer detectors can be installed on the loop before the loop current limit is reached, making retrofitting of existing systems very expensive.

What is needed, therefore, is a fast responding combined smoke and fire detector having a markedly reduced operating current and nuisance alarm rate.

SUMMARY OF THE INVENTION

An object of this invention is, therefore, to provide an apparatus and a method for rapidly detecting fires while reducing the nuisance alarm rate.

Another object of this invention is to provide an operating electrical current-saving method of operating a combined smoke and fire detecting system.

A further object is to provide a reliability improving method of operating a combined smoke and fire detecting system.

A fire detection system of this invention includes a smoke detector that measures smoke particle density indicative of smoldering fires and a $CO_2$ detector that measures $CO_2$ concentration indicative of flaming fires. The invention includes operating methods that reduce nuisance alarms and operating current while increasing the reliability of the fire detection system.

In a first operating current saving method, the smoke detector is operated to acquire smoke samples at a normal pulse repetition frequency ("PRF") while the $CO_2$ detector is operated to acquire gas samples at a very slow, or zero, PRF. Smoke density measurements produced by the smoke detector are compared with a set of tentative fire detection criteria, and if met, the $CO_2$ detector PRF is substantially increased to rapidly produce $CO_2$ concentration measurements that are compared to a set of conclusive fire detection criteria.

In a second operating current-saving method, the $CO_2$ detector is operated to acquire gas samples at a normal PRF while the smoke detector is operated to acquire smoke samples at a zero PRF. $CO_2$ concentration measurements produced by the $CO_2$ detector are compared with a set of tentative fire detection criteria, and if met, the smoke detector PRF is substantially increased to rapidly produce smoke density measurements that are compared to a set of conclusive fire detection criteria.

In a reliability improving operating method, operating characteristics, preferably electrical current draw and/or signal presence, of the smoke and $CO_2$ detectors are monitored to determine whether either detector has failed. If a failure is detected, fire detection criteria normally employed are changed to criteria optimized for the remaining detector, and a detector failure indication is generated.

Additional objects and advantages of this invention will be apparent from the following detailed description of preferred embodiments thereof which proceeds with reference to the accompanying drawings.

DETAILED DESCRIPTION OF PREFERRED EMBODIMENTS

Figure 1:
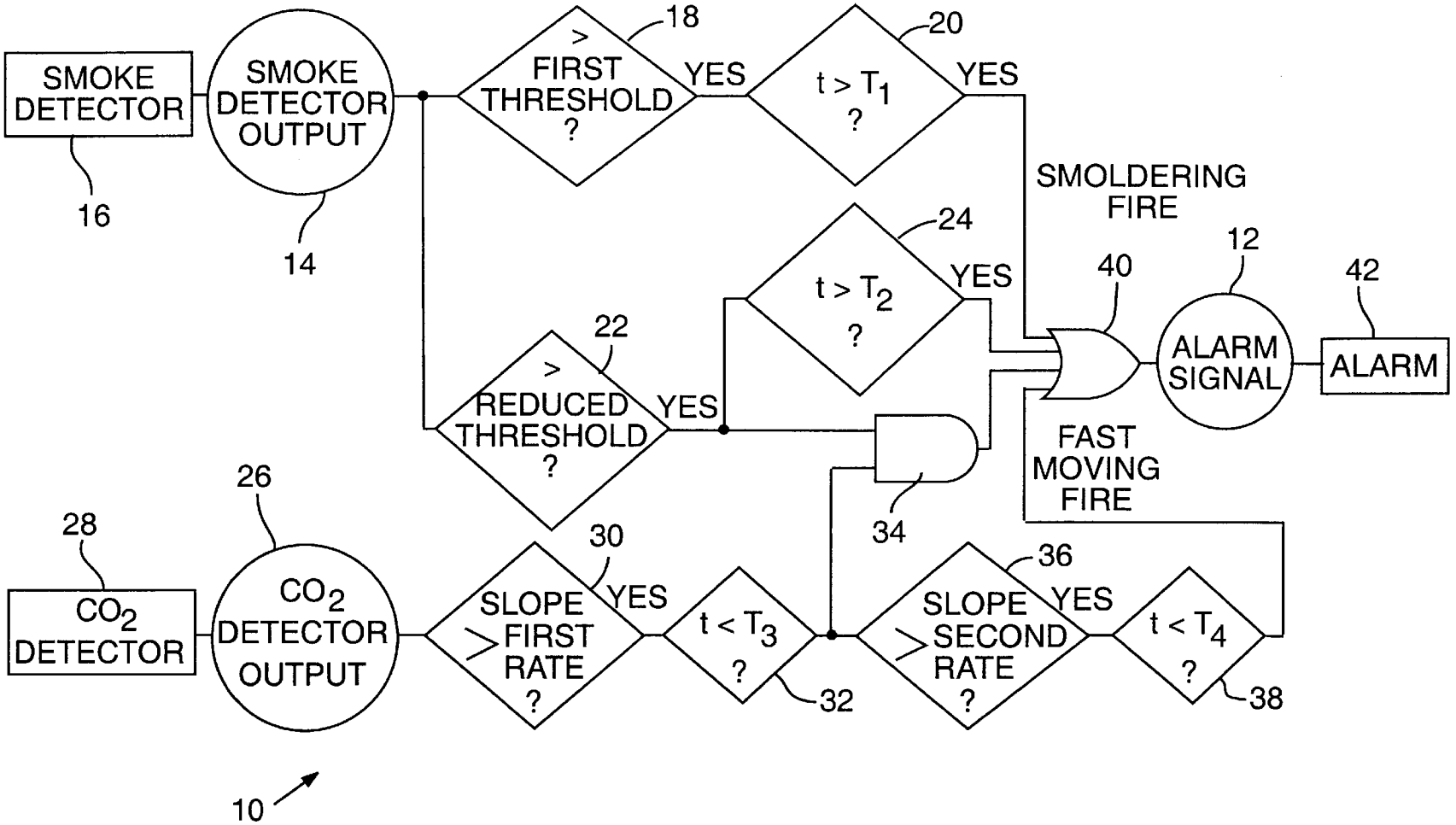
FIG. 1 is a logic diagram showing preferred signal processing carried out by a combined smoke and fire detector of this invention.

FIG. 1 is a logic diagram of an embodiment of a practical and improved fire detection system 10. As shown in FIG. 1, fire detection system 10 generates an alarm signal 12 when any of four conditions is met.

First, alarm signal 12 is generated whenever an output 14 of a smoke detector 16 exceeds a threshold level 18 of 3.0 percent light obscuration per 0.3048 meter (1 foot) for greater than a first preselected time 20 of about two minutes. Smoke concentration is typically measured in units of "percent" light obscuration per 0.3048 meter (1 foot). This terminology is derived from the use of projected beam or extinguishment photoelectric smoke detectors in which a beam of light is projected through air, and the attenuation of the light beam by smoke particles is measured. Even when referring to the measurements of a device that uses another mechanism for measuring smoke concentration, such as light reflection or ion flow sampling, the smoke concentration measurement is frequently specified in terms of percent light obscuration per 0.3048 meter (1 foot) because these units are familiar to skilled persons.

Second, alarm signal 12 is generated whenever output 14 from smoke detector 16 exceeds a reduced threshold level 22 ranging from about 0.25 to about 0.5 percent light obscuration per 0.3048 meter (1 foot) for greater than a second preselected time 24 ranging from about 4 minutes to about 15 minutes.

Third, alarm signal 12 is generated whenever the rate of increase in the measured concentration of $CO_2$ at an output 26 of a $CO_2$ detector 28 exceeds a first predetermined rate 30 of about 100 parts-per-million per minute for a predetermined time period 32 of fewer than about 30 seconds and light obscuration exceeds reduced threshold 22. The output of an AND gate 34 indicates the satisfaction of this condition.

Fourth, alarm signal 12 is generated whenever the rate of increase in the measured concentration of $CO_2$ exceeds a second predetermined rate 36 of about 700 to about 1000 parts-per-million per minute for a predetermined time period 38 of fewer than about 60 seconds.

These four conditions are combined by an OR gate 40, the output of which produces alarm signal 12 that in turn activates an alarm device 42.

Figure 2:
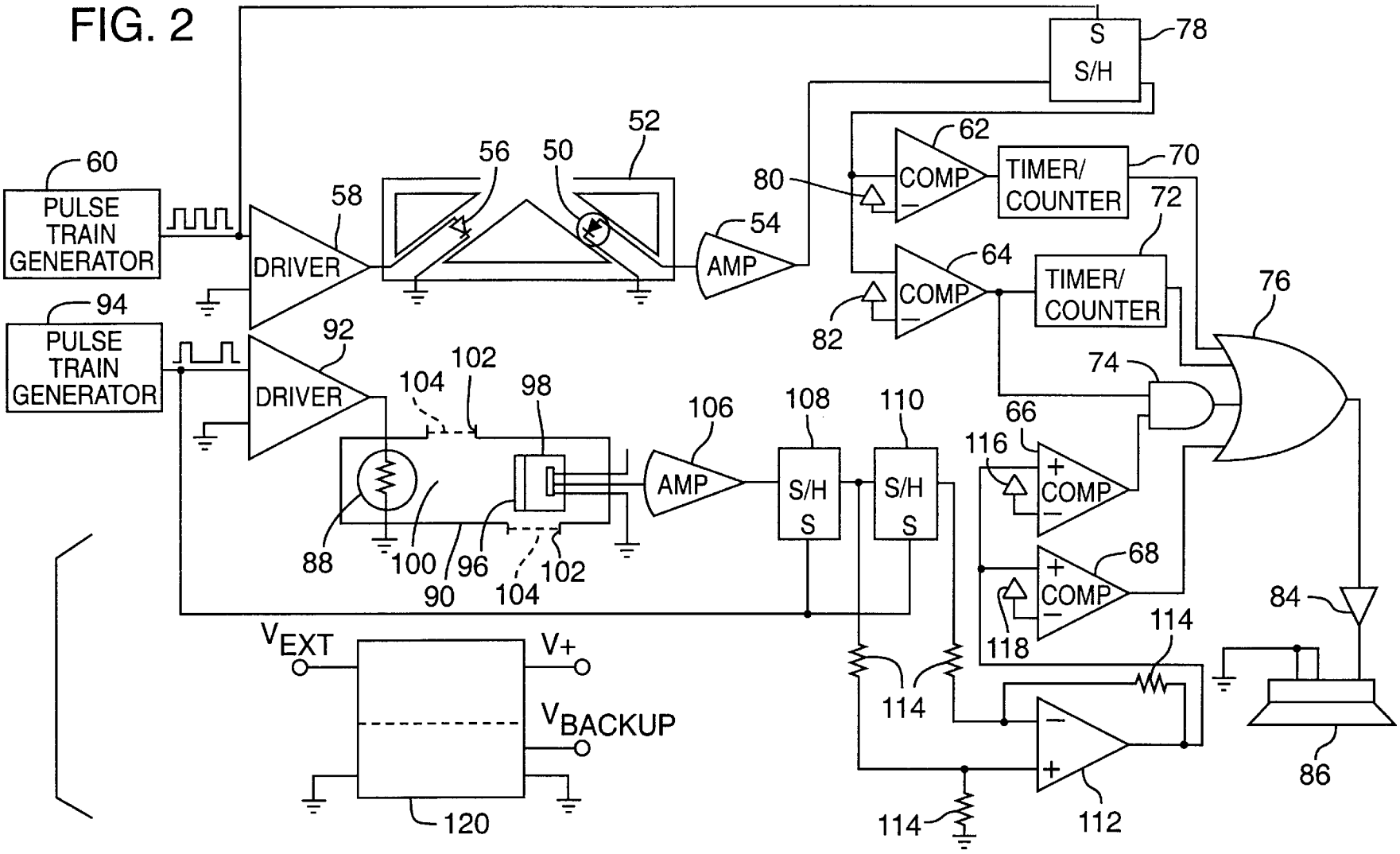
FIG. 2 is an electrical schematic diagram of the combined smoke and fire detector of FIG. 1 further showing the signal processing circuit elements supporting a photoelectric smoke detector and a nondispersive infrared ("NDIR") $CO_2$ detector.

FIG. 2 shows a preferred implementation of the logic elements of fire detection system 10. A silicon photodiode 50 of a photoelectric smoke detector 52 (16 of FIG. 1) drives a transimpedance amplifier 54 (14 of FIG. 1). A light-emitting diode ("LED") 56 of photoelectric smoke detector 52 is pulsed on and off by a driver 58, which is driven by a pulse train generator 60 that emits a pulse stream having a PRF of about six pulses per minute ("ppm") at a pulse width of about 300 $\mu$sec, thereby causing LED 56 to emit a corresponding pulsed light signal. LED 56 is referred to as being "pulsed on" when emitting light and "pulsed off" when dark.

Photoelectric detector 52 is preferably a light reflection type smoke detector, in which photodiode 50 is located off axis from a straight line path of light travel from LED 4. Consequently, light propagating from LED 56 reaches photodiode 50 only if smoke reflects the light off axis into the path of photodiode 50. Under normal operating conditions, i.e., in the absence of smoke particles, the output of photodiode 50 generates a constant zero ampere electrical current because very little light is scattered into it from LED 56. During a fire in which smoke particles are present in the space between LED 56 and photodiode 50, a pulse stream output signal having a magnitude dependent on the smoke particle density appears at the output of transimpedance amplifier 54.

The logic elements of fire detection system 10 further include comparators 62, 64, 66, and 68 (respectively 18, 22, 30, and 36 of FIG. 1); timer/counters 70 and 72 (respectively 20 and 24 of FIG. 1); an AND gate 74 (34 of FIG. 1); and an OR gate 76 (40 of FIG. 1), each having a discrete logic output signal. The logic output signals assume one of two distinct voltage levels depending on the input signal applied to the respective component. The higher of the two voltage levels is generally referred to as a "high" output, and the lower of the two voltage levels is generally referred to as a "low" output.

A sample and hold circuit 78 is commanded to sample the output of transimpedance amplifier 54 every pulse train cycle by the output of pulse train generator 60. The output of sample and hold circuit 78 is conveyed to a high threshold comparator 62 and a low threshold comparator 64. A reference voltage 80 applied to the inverting input of high threshold comparator 62 corresponds to a signal strength of scattered light at photodiode 50 that indicates a level of smoke concentration sufficient to cause approximately 3.0 percent light obscuration per 0.3048 meter (1 foot) of the light emitted by LED 56. Thus, when the smoke concentration at detector 52 exceeds this level, the output of high threshold comparator 62 will be high. Similarly, a reference voltage 82 applied to the inverting input of low threshold comparator 64 corresponds to a signal strength of scattered light at photodiode 50 that indicates a level of smoke concentration sufficient to cause from about 0.25 to about 0.5 percent light obscuration per 0.3048 meter (1 foot) of the light emitted by LED 56. Thus, when the smoke concentration at detector 52 exceeds this level, the output of low threshold comparator 64 will be high.

The outputs of comparators 62 and 64 are connected to respective timer/counters 70 and 72. For a relatively rapid detection of relatively high smoke density nonflaming fires, timer/counter 70 generates a high output if the output of high threshold comparator 62 stays high for longer than about 4 to about 15 minutes. For a relatively slow detection of relatively low smoke density nonflaming fires, timer/counter 72 generates high output if the output of low threshold comparator 64 stays high for longer than 15 minutes. Timer/counters 70 and 72 are activated only when the output logic states of the respective comparators 62 and 64 are high. The outputs of timer/counters 70 and 72 constitute two of the four inputs to OR gate 76. A high output generated by OR gate 76 indicates detection of a fire. This signal is amplified by an amplifier 84 (12 of FIG. 1) and is used to sound an auditory alarm 86 (42 of FIG. 1).

An infrared source 88 of an NDIR $CO_2$ detector 90 (28 of FIG. 1) is pulsed by a current driver 92, which is driven by a pulse train generator 94 at a PRF of about 6 ppm. The pulsed infrared light radiates through a thin film, narrow bandpass optical filter 96 and onto an infrared detector 98. Optical filter 96 has a center wavelength of about 4.26 microns and a full width at half maximum (FWHM) bandwidth of approximately 0.2 micron. $CO_2$ has a strong infrared absorption band spectrally located at 4.26 microns. The quantity of 4.26 micron light reaching infrared detector 98 depends inversely on the concentration of $CO_2$ present between infrared source 88 and infrared detector 98.

Infrared detector 98 is preferably a single-channel, micromachined silicon thermopile with an optional built-in temperature sensor in intimate thermal contact with a reference junction. Infrared detector 98 may alternatively be a pyroelectric sensor. In an additional alternative, the function of infrared detector 98 could be performed by other types of detectors, including metal oxide semiconductor sensors, such as a "Taguchi" sensor, or electrochemical and photochemical (e.g. colorometric) sensors, but as skilled persons will appreciate, the supporting electrical circuitry would have to be different. $CO_2$ detector 90 has a sample chamber 100 with small openings 102 on opposite sides that enable ambient air to diffuse through sample chamber 100 between infrared source 88 and infrared detector 98. Small openings 102 are covered with a fiberglass-supported silicon membrane 104 to transmit $CO_2$ and other gasses while preventing dust and moisture-laden particulate matter from entering sample chamber 100. This type of membrane and its use are described in U.S. No. Pat. No. 5,053,754 for SIMPLE FIRE DETECTOR.

The output of the infrared detector 98 is an electrical pulse stream that is amplified by an amplifier 106 (26 of FIG. 1). A second sample and hold circuit 108 is commanded every pulse cycle by pulse train generator 94 to sample the amplified pulse stream. Likewise, for every pulse cycle, the output of sample and hold circuit 108 is sampled by a third sample and hold circuit 110. A unity gain, differential operational amplifier 112 subtracts the output of second sample and hold circuit 108, which represents the sample immediately preceding the latest sample, from the output of third sample and hold circuit 110, which represents the latest sample. Amplifier 112 is configured to unity gain by four resistors 114, preferably each having a value of about 10,000 ohms. The resultant voltage generated by amplifier 112 is proportional to the rate of change of $CO_2$ concentration and is conveyed to an input of each of a pair of comparators 66 and 68 (respectively 30 and 36 of FIG. 1) each having a different threshold reference voltage.

Comparator 66 is a low rate of rise-detecting comparator having a reference voltage 116 that corresponds to a rate of change of $CO_2$ concentration of about 100 parts-per-million per minute. When this $CO_2$ concentration change rate is exceeded in less than a predetermined time period, the output of comparator 66 goes high, a condition that is conveyed to AND gate 74. Because the output of low threshold comparator 64 is connected to another input of AND gate 74, the output of AND gate 74 is high only when the smoke particle concentration is sufficient to cause light obscuration of about 0.25 to about 0.5 percent per 0.3048 meter (1 foot) AND the $CO_2$ concentration is increasing at a rate of at least 100 parts-per-million per minute.

Comparator 68 is the high rate of rise comparator having a reference voltage 118 that corresponds to a $CO_2$ concentration rate of change of approximately 1,000 parts-per-million per minute. When this $CO_2$ rate of change is exceeded in less than a predetermined time period, comparator 68 output goes high, a condition which is conveyed to a fourth input of OR gate 76.

A power supply module 120 receives, preferably from a battery, an external supply voltage $V_{EXT}$ and generates a regulated voltage V+for powering the abovedescribed circuitry.

Alternatively, a projected beam, or extinguishment-type smoke detector, could be used as a substitute for photoelectric smoke detector 52. Extinguishment smoke detectors direct a beam of light through the atmosphere to a light detector that measures light attenuation caused by smoke. This type of detector is useful in a cavernous indoor space, such as an atrium. Additionally, technology improvements are reducing the cost and improving the accuracy of extinguishment detectors that are usable in a small housing. An advantage of extinguishment detectors is their sensitivity to the fine smoke particles produced by flaming fires. Because $CO_2$ detector 90 and smoke detector 52 are combined, the smoke detector accuracy requirements are reduced, allowing a relatively inexpensive extinguishment detector to be used in the present invention.

Figure 3:
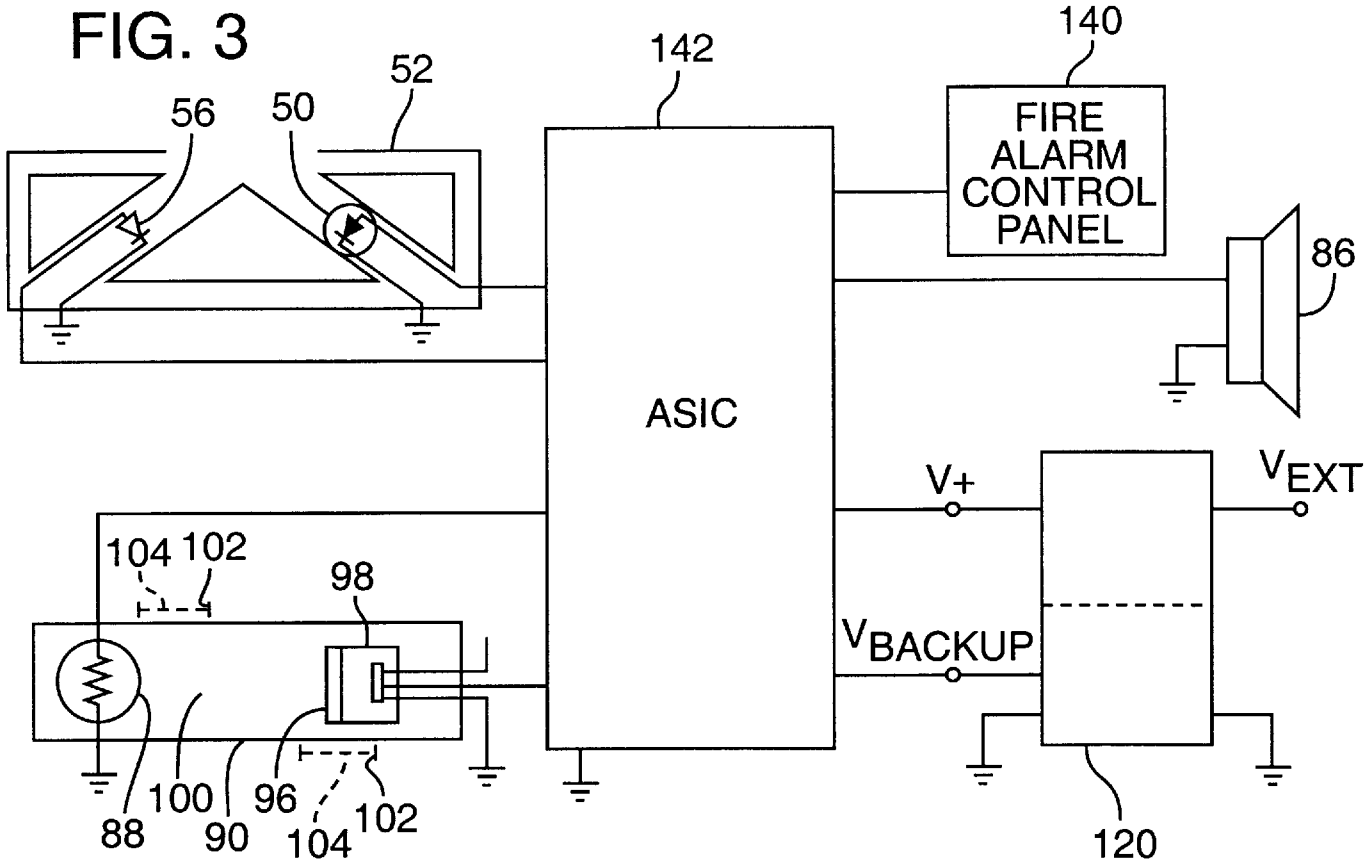
FIG. 3 is an electrical schematic diagram showing an alternative embodiment of a combined smoke and fire detector of this invention.

In the embodiment shown in FIG. 3, all the circuit elements described and shown in FIG. 2, with the exception of smoke detector 52, $CO_2$ detector 90, power supply module 120, and auditory alarm 86, are integrated using well-known techniques into a single ASIC 142. Additionally, ASIC 142 may include circuitry for digitizing and formatting the signals representing $CO_2$ concentration, rate of change of $CO_2$ concentration, smoke concentration, and the presence of an alarm signal. Such circuitry would typically include an analog-to-digital converter ("ADC") and a microprocessor section for formatting the signal into a serial format.

The digitized signals are transmitted typically over a serial bus to a fire alarm control panel 140 unless the detector is a standalone type detector such as the detectors listed under UL 217 standards. Serial communications are a natural choice because the volume of data is typically low enough to be accommodated by this method and reducing power consumption is a consideration.

Fire alarm control panel 140 preferably performs the data analysis to determine the presence of a fire. In this instance, the fire detection system is considered to encompass fire alarm control panel 140.

Figure 4:
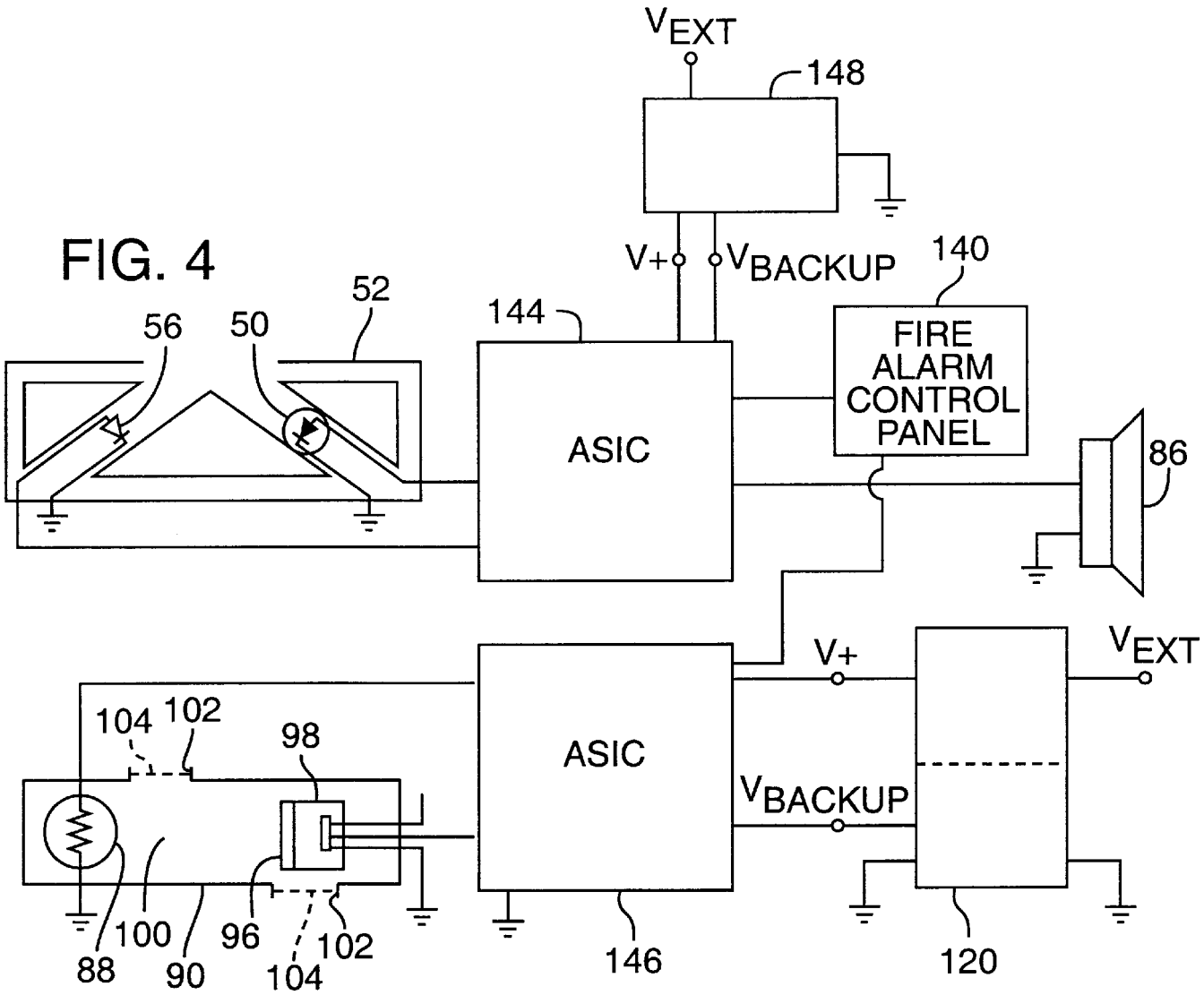
FIG. 4 is an electrical schematic diagram showing a variant of the combined smoke and fire detector of FIG. 3.

FIG. 4 shows a variant of this embodiment in which a first ASIC 144 receives, digitizes, and formats the signal received from smoke detector 52. First ASIC 144 conveys the resultant data to fire alarm control panel 140. A second ASIC 146 receives, digitizes, and formats the signal received from $CO_2$ detector 90. Second ASIC 146 conveys the resultant data to fire alarm control panel 140. A second power supply module 148 powers first ASIC 144. In this embodiment, first ASIC 144 and smoke detector 52 may be physically separate and a distance away from second ASIC 146 and $CO_2$ detector 90.

Figure 5:
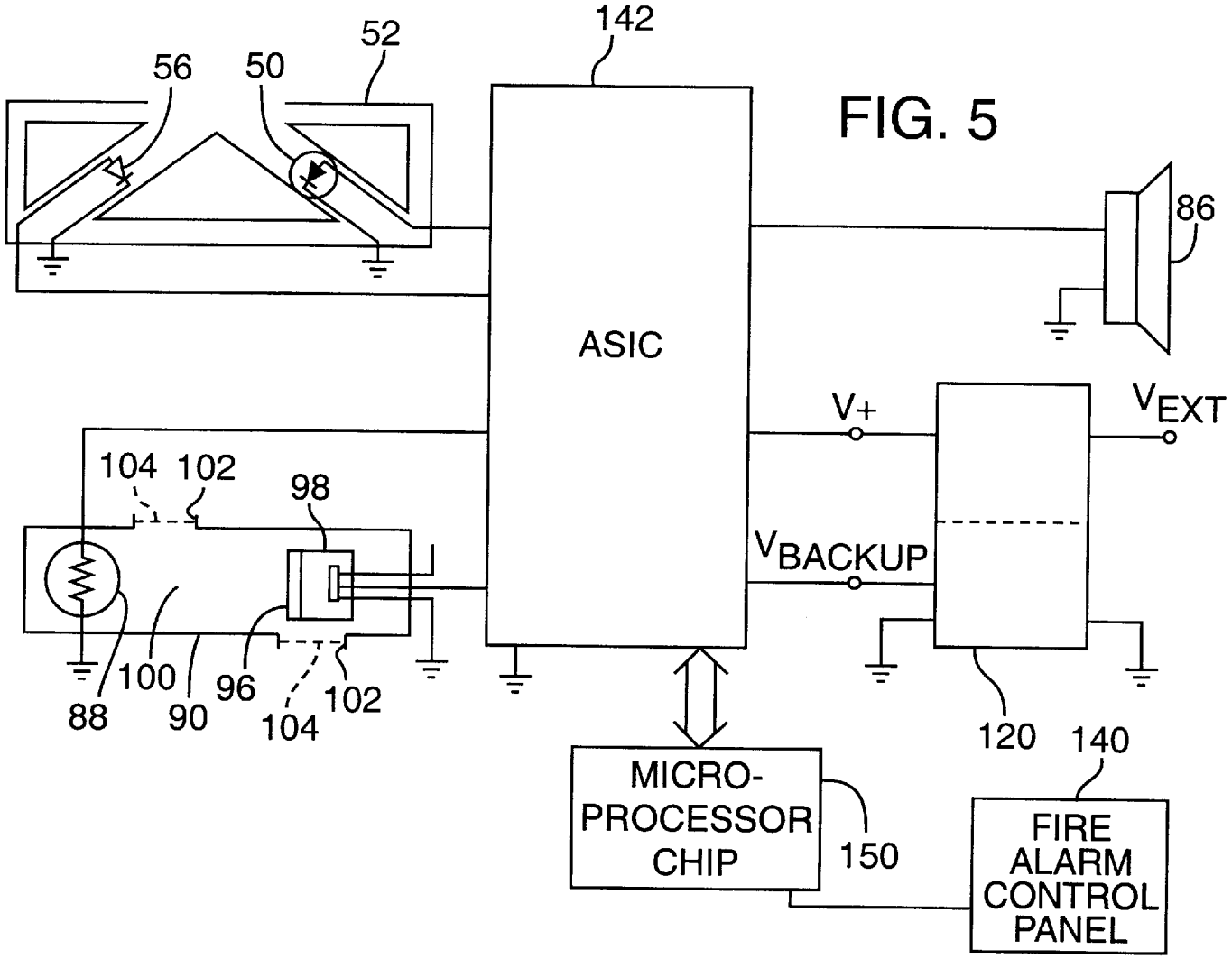
FIG. 5 is an electrical schematic diagram showing another variant of the combined smoke and fire detector of FIG. 3.

FIG. 5 shows another alternative preferred embodiment in which a microprocessor 150 communicates with ASIC 142 via a data bus. Commercially available microprocessors typically cannot directly drive LED 56 and infrared source 88. Therefore ASIC 142 includes driver circuitry for performing these functions. ASIC 142 also includes an ADC and amplifiers for converting smoke detector 52 and $CO_2$ detector 90 outputs into voltage ranges compatible with the ADC. Microprocessor 150 receives the digitized data from the ADC and is programmed to compute the smoke concentration, the $CO_2$ concentration, the rate of change of $CO_2$ concentration, and to implement the detection logic shown in FIG. 1. ASIC 142 receives the digital results of this process from microprocessor 150 and changes an alarm condition into a form that drives alarm 86.

In a variation of the FIG. 5 embodiment, smoke and $CO_2$ concentration sample values generated by the ADC are processed by a digital filter function implemented in microprocessor 150. The digital filter function output is compared with a threshold to determine whether an alarm condition exists. In this embodiment, smoke concentration samples "A1" (taken at six samples per minute) are processed by an alpha filter of the following form:

$$A1_N' = \alpha A1_N + (\alpha - 1) A1_{N-1},$$

where $\mathbf{A1}_N$ is the most recent smoke concentration sample, $\mathbf{A1}_{N-1}$'is the previous alpha-filtered smoke concentration value, and $\mathbf{A1}_N'$ is the newly computed, alpha-filtered smoke concentration value. The value of $\alpha$ is preferably 0.3, and a threshold is set equal to a constant light obscuration level of 4.0 percent per 0.3048 meter (1 foot). The $CO_2$ concentration rate samples ("$\mathbf{A2}_N'$," computed at a rate of 1 every 10 seconds) are also processed by an alpha filter. The value of the $CO_2$ concentration rate $\alpha$ is preferably 0.2, and an alarm threshold is set equal to a rate of change of 500 parts-per-million per minute. In addition, every 10 second time interval a quantity $Q_N$ is formed by the following equation:

$$Q_N = A1_N' + A2_N'$$

where $\mathbf{A1}_N'$ is normalized so that 1.0 percent light obscuration per 0.3048 meter (1 foot) equals 1.0, and $\mathbf{A2}_N'$ is normalized so that a 100 parts-per-million per minute rate equals 1.0. An alarm threshold for $Q_N$ is set to 1.8. When any one of the alarm thresholds is exceeded, an alarm indication is generated and conveyed to a user or to a recipient device.

In this embodiment, A1N' and $\mathbf{A2}_N'$ could be processed by a linear, quadratic, or other polynomial form equation prior to combination. For example, $Q_N$ could have the following form:

$$Q_N = a_1(A1_N')^2 + b_1 A_1 + a_2(A2_N') + b_2 A2_N' + c$$

where $a_1$=0.1; $b_1$=1.0; $a_2$=0.1; $b_2$=1.0; and c=0. The general purpose of using quadratic terms is to declare an alarm when one quantity becomes large while the other quantity is small.

An alpha filter is one example of a recursive or infinite impulse response ("IIR") filter. A finite impulse response ("FIR") filter may alternatively be used. A suitable FIR filter should be responsive to instantaneous level, rate of change (the first derivative), and the derivative of the rate of change (the second derivative). For example, a three sample FIR filter would have the following form:

$$A1_N' = k_1 A1_N + k_2 A1_{N-1} + k_3 A1_{N-2}$$
$$A2_N' = k_1 A2_N + k_2 A2_{N-1} + k_3 A2_{N-2}$$
$$Q_N = A1_N' + A2_N'.$$

The constant values $k_1$=4.0; $k_2$=−2.5; and $k_3$=0.5 yield a filter that responds to instantaneous level, rate of change, and acceleration over a three sample interval. Multiplication by these constants can readily be implemented on a microcomputer, such as microprocessor 150. Skilled persons will appreciate that a digital filter can also be implemented in hardware with a number of delay or sample and hold circuits and amplifiers set to implement the desired constants.

As pointed out in the background of this invention, to acquire smoke samples, smoke detector 52 typically draws about 200 microamps of operating current and $CO_2$ detector 90 typically draws about 300 microamps and therefore results in a combined smoke and fire detector that draws more than twice the operating current of a smoke detector alone. However, the following operating methods for the combination of smoke detector 52 and $CO_2$ detector 90 decrease the overall operating current and increase the reliability of the resulting smoke and fire detection system.

In a first operating current-saving operating method, one of ASIC 142, fire alarm control panel 140, and microprocessor 150, depending on the detector embodiment, pulses smoke detector 52 at a nominal PRF of about six ppm and pulses $CO_2$ detector 90 at a comparatively low PRF of less than about two ppm, and preferably zero ppm. Referring also to FIG. 1, output 14 of smoke detector 52 is compared with reduced threshold 22 such that when threshold 22 is exceeded, a tentative fire detection criterion has been met. In response, one of ASIC 142, fire alarm control panel 140, or microprocessor 140, depending on the detector embodiment, starts pulsing $CO_2$ detector 90 at a relatively high PRF of greater than about 10 ppm, and preferably about 12 ppm. The resulting $CO_2$ concentration rate of change measurements described with reference to FIG. 1 are used to determine whether a conclusive fire detection criterion has been met.

An advantage of this first operating method is the reduced operating current otherwise drawn by the combined dual detector system. Such a reduction makes battery powered operation practical. This operating current savings is particularly advantageous in a large industrial system having hundreds of detector units that draw operating current from a wire loop. The reduced operating current drawn by the combined fire and smoke detector of this invention increases the maximum number of such detectors that may be wired into the loop.

Another advantage of pulsing $CO_2$ detector 90 at a slow or zero rate is increased life of infrared source 88. This is particularly advantageous if infrared source 88 is an incandescent light bulb.

In a second operating current-saving operating method, one of ASIC 142, fire alarm control panel 140, or microprocessor 150, depending on the detector embodiment, pulses $CO_2$ detector 90 at a nominal PRF of fewer than about six ppm but does not pulse smoke detector 52. Output 26 of $CO_2$ detector 90 is processed as described with reference to FIG. 1 to determine whether a tentative fire detection criterion has been met, and if it has, one of ASIC 142, fire alarm control panel 140, or microprocessor 150, depending on the detector embodiment, starts pulsing smoke detector 52 at the nominal PRF of about six ppm. The resulting smoke measurements are compared against either of smoke thresholds levels 18 and 22 to determine whether a conclusive fire detection criterion has been met.

Although this operating method does not save so much operating current as that saved by the first operating method, it is advantageous because $CO_2$ disperses more rapidly than smoke and, therefore, provides an earlier indication of a fire.

In a reliability improving operating method, ASIC 142, fire alarm control panel 140, or microprocessor 150, depending on the embodiment, is adapted to detect a failure of either $CO_2$ detector 90 or smoke detector 52 and respond by altering the fire detection criteria to a set suitable for the remaining operating detector. In this method, detector failure may be determined by monitoring the status of operating current draw or presence of output signals from $CO_2$ detector 90 or smoke detector 52. The operating current draw and output signal status are referred to herein as "performance characteristics" of smoke detector 52 and $CO_2$ detector 90, which performance characteristics should fall within a predetermined range of nominal values. Cessation of either performance characteristic is indicative of a failure of the relevant detector.

If $CO_2$ detector 90 or smoke detector 52 fails, the detection logic resident in ASIC 142, fire alarm control panel 140, or microprocessor 150 switches to an alternative set of fire detection criteria adapted to detecting fires using the remaining operating detector. In particular, if $CO_2$ detector 90 fails, first preselected time 20 is preferably reduced from two minutes to 15 seconds, and if smoke detector 52 fails, rate of change of $CO_2$ concentration rate threshold 36 is preferably reduced to 350 parts-per-million per minute.

This operating method may further include a step in which one of ASIC 142, fire alarm control panel 140, and microprocessor 140, depending on the detector embodiment, generates a failure indication or generates a message that notifies maintenance personnel of a detector failure. Moreover, this method of adapting to the failure of one detector by using the remaining functional detector provides a smoke and fire detection system having a markedly improved failure rate, which is highly advantageous should a fire occur while one of the detectors has failed.

Skilled workers will recognize that portions of this invention may be implemented differently from the implementations described above for a preferred embodiment. For example, the above-described logic may be implemented as a program in ASIC 142, 144, or 146, fire alarm control panel 140, or microprocessor 150. Alternatively, the above-described logic may implemented as a circuit employing discrete components. It is also possible to enclose the two detectors in a single housing or to operate them in a network that distributes particular detector types at strategically selected placed fire- and smoke-detecting locations in a building. In such a network, a fire alarm control panel receives data from the network of detectors and reports their status on a map showing the locations. Each detector is logically identifiable to distinguish its location from the locations of the other detectors. Such a status map is invaluable to the safety and effectiveness of fire fighters arriving at the scene of a fire.

It will be further obvious to those having skill in the art that many changes may be made to the details of the above-described embodiments of this invention without departing from the underlying principles thereof. The scope of this invention should, therefore, be determined only by the following claims.

I claim:

1. In a fire detection system including a first detector that generates in response to first pulses a first signal representative of a first measurement and a second detector that generates in response to second pulses a second signal representative of a second measurement, a method of reducing operating current drawn by the fire detection system in response to the first and second pulses, comprising:

applying the first pulses to the first detector at a first pulse repetition frequency ("PRF");

applying the second pulses to the second detector at a second PRF that is substantially less than the first PRF;

comparing the first signal to a predetermined set of tentative fire detection criteria;

determining whether a member criterion of the predetermined set of tentative fire detection criteria is satisfied, and if it is;

increasing the second PRF to a third PRF that is substantially greater than the second PRF;

comparing at least one of the first and second signals to a predetermined set of conclusive fire detection criteria; and generating an alarm signal if any member criterion of the predetermined set of conclusive fire detection criteria is satisfied.

2. The method of claim 1 in which the first detector is a smoke detector and the first measurement is a smoke particle concentration measurement, and in which the second detector is a $CO_2$ detector and the second measurement is a $CO_2$ concentration measurement.

3. The method of claim 2 in which the second PRF is less than about 2 pulses per minute.

4. The method of claim 2 in which the third PRF is greater than about 10 pulses per minute.

5. The method of claim 2 in which the predetermined set of tentative fire detection criteria include exceeding a smoke threshold level ranging from about 0.25 to about 0.5 percent light obscuration per 0.3048 meter.

6. The method of claim 2 in which the predetermined set of conclusive fire detection criteria include exceeding a threshold rate of increase in a concentration of $CO_2$ ranging from about 100 to about 1,000 parts-per-million per minute.

7. The method of claim 1 in which the first detector is a $CO_2$ detector and the first measurement is a $CO_2$ concentration measurement, and in which the second detector is a smoke detector and the second measurement is a smoke particle concentration measurement.

8. The method of claim 7 in which the second PRF is substantially zero pulses per minute.

9. The method of claim 7 in which the predetermined set of tentative fire detection criteria include exceeding a threshold rate of increase in a concentration of $CO_2$ ranging from about 100 to about 1,000 parts-per-million per minute.

10. The method of claim 7 in which the predetermined set of conclusive fire detection criteria include exceeding a smoke threshold level of 1.0 percent light obscuration per 0.3048 meter.

11. The method of claim 1 in which the first and second detectors are enclosed within a unitary smoke and fire detector housing.

12. The method of claim 1 in which the at least two of the first, second, and third PRFs are controlled by a centralized control panel.

* * * * *